United States Patent [19]

Martin

[11] 4,142,307

[45] Mar. 6, 1979

[54] SKI AND SKATING BOOT

[76] Inventor: Hans Martin, Chasernweg 7, Kloten, Switzerland

[21] Appl. No.: 867,445

[22] Filed: Jan. 6, 1978

[30] Foreign Application Priority Data

Jan. 7, 1977 [CH] Switzerland ..... 192/77
Dec. 28, 1977 [CH] Switzerland ..... 16025/77

[51] Int. Cl.[2] ..... A43B 11/00; A43C 11/00; A43B 5/04

[52] U.S. Cl. ..... 36/50; 36/117; 24/68 SK

[58] Field of Search ..... 36/117, 118, 119, 50; 24/68 SK, 69 SK, 70 SK, 71 SK

[56] References Cited

U.S. PATENT DOCUMENTS 3,193,950 7/1965 Liou ..... 36/50
3,545,106 12/1970 Martin ..... 36/50

FOREIGN PATENT DOCUMENTS 1325825 3/1963 France ..... 36/50

*Primary Examiner*—Patrick D. Lawson
*Attorney, Agent, or Firm*—Roylance, Abrams, Berdo & Farley

[57] ABSTRACT

The boot has closing flaps and a fastening. The fastening includes a first tension member guided alternately between the closing flaps by guides, to cover an insertion opening in the upper part of the boot located in the vicinity of the instep, as well as a tightening fastener connected to the end of the first tension member. The tightening fastener includes a tightening lever located on one closing flap and a fastening clip on the other closing flap. The clip is connected to the first tension member. The tightening lever is connected to one end of a second tension member also guided alternately between the closing flaps by guides.

7 Claims, 8 Drawing Figures

SKI AND SKATING BOOT

The invention relates to a ski and skating boot with a fastening which spans its closing flaps and which covers the insertion opening in the upper part of the boot located in the vicinity of the instep by means of a first tension member guided alternately between the closing flaps by guides, the end of said tension member being connected to a tightening fastener, whereby a tightening lever of the fastener is located on one closing flap and the upper end of the first tension member with its guide and a fastening clip connectable with a tightening strap of the tightening lever are arranged on the other closing flap.

For certain sports shoes and boots, particularly ski boots and boots for ice hockey and skating it is necessary to close and tighten the insertion opening located in the upper part of the boot after putting on said boot, so that the latter houses the foot firmly and without any clearance.

Ski boots are known (U.S. Pat. Nos. 3,545,106 and 3,975,838) which bring about the tightening of the boot on the foot by means of a single tightening device. In this case a tension cable guided in guides is placed in alternating manner over the closing flaps of the upper part of the boot, said cable being connected at its upper end with a single tightening lever mechanism arranged in two tightening flaps of the shaft portion on the instep side. This tightening lever mechanism makes it possible to meter the degree of tightening of the boot and also permits the easy loosening thereof.

When using these known fastening devices it is possible to open the insertion opening in the upper part of the boot located in the vicinity of the instep by the tightening length of the tightening lever mechanism. This opening length corresponding to the tightening length may not be adequate in the case of ski boots made from plastics materials where, due to the greater rigidity of the plastic, entry into the ski boot is more difficult, so that it is necessary to fit a portion which can be flapped out on the shaft, e.g. on the heel portion. This makes the ski boot more complicated and therefore more expensive.

The problem of the invention is to so construct the fastening in a ski or skating boot of the type described hereinbefore that the putting on and taking off of the boot is facilitated and additionally there is a greater tightening length for tightening the boot, without thereby complicating the design thereof.

According to the invention this problem is solved in that the tightening lever of the tightening strap is arranged on a tension bar which is connected to one end of a second tension member guided by means of guides and passing in alternating manner between the closing flaps.

Figure 1:
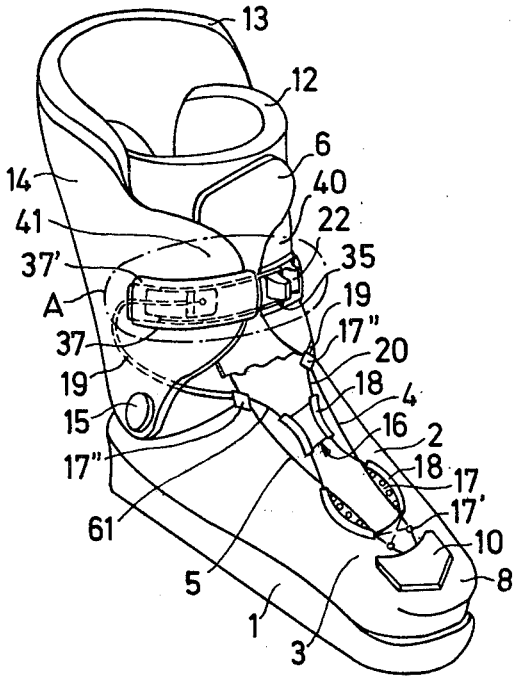

The invention is explained hereinafter relative to non-limitative embodiments and with reference to the drawings, wherein show:

FIG. 1 a diagrammatic three-dimensional view of a ski boot in which the covering tongue extending over the instep portion is partly broken away.

Figure 2:
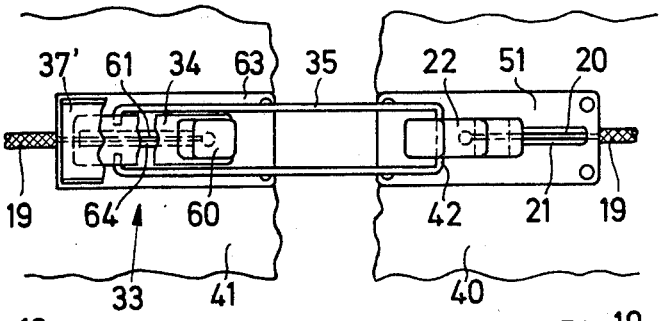

FIG. 2 a front view of portion A of FIG. 1, whereby individual parts of the tightening fastener are broken away.

Figure 3:
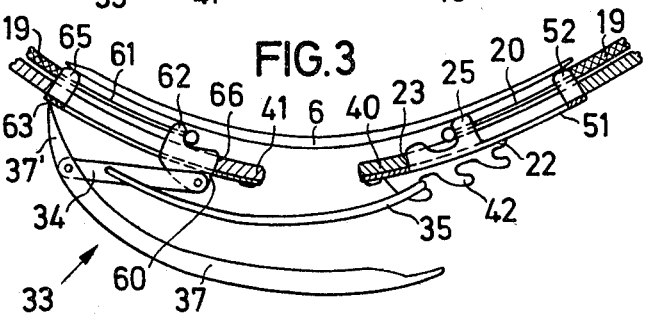

FIG. 3 a section through portion A of FIG. 2, whereby the tightening fastener is shown in the partly open position.

Figure 4:
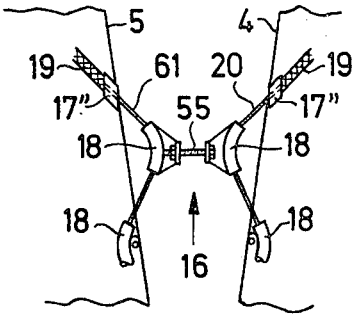
Figure 5:
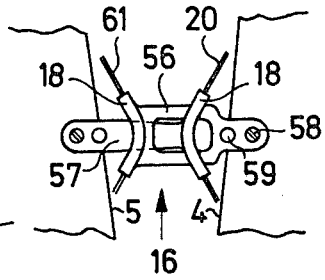
Figure 6:
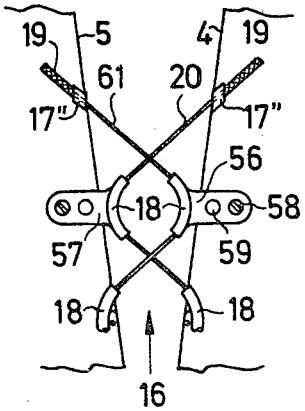

FIGS. 4 – 6 three different embodiments of guidance members for the longitudinal setting of the two tension members.

Figure 7:
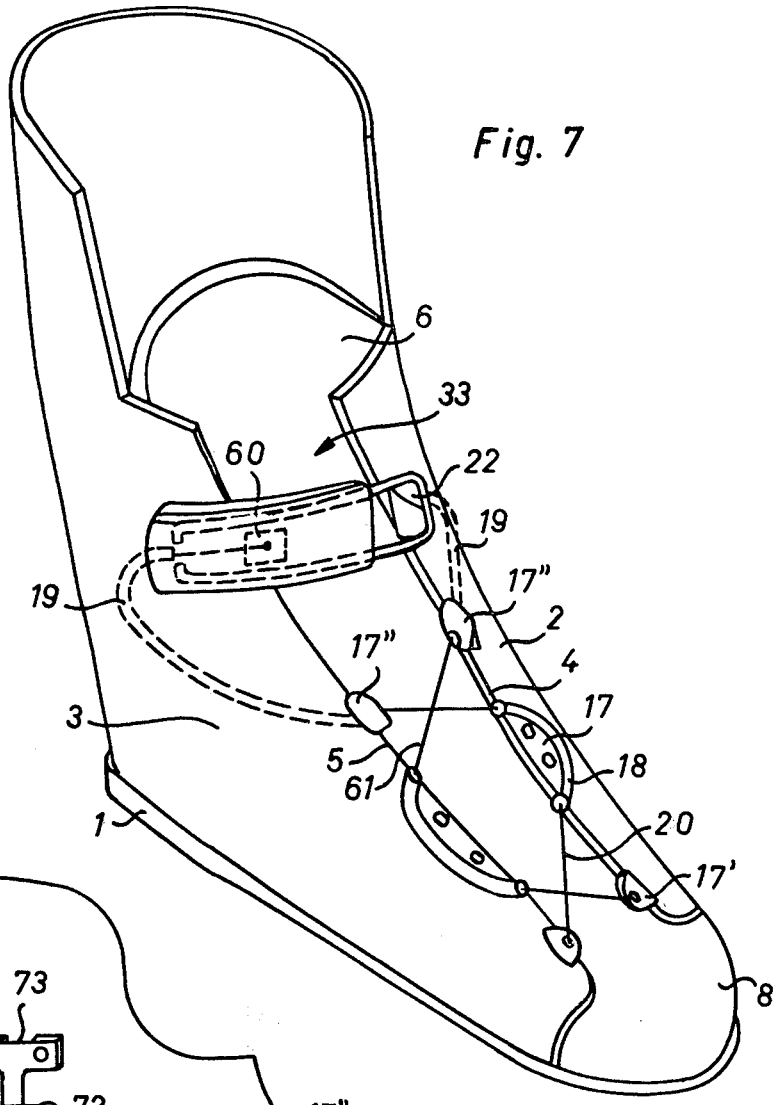

FIG. 7 the arrangement of the tension members in the case of an ice hockey boot.

Figure 8:
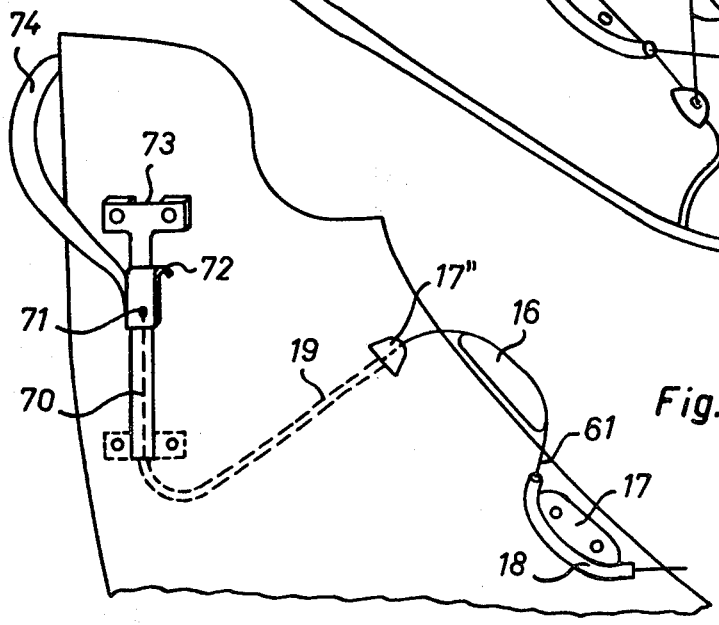

FIG. 8 the arrangement of the tension members in the case of a further ice hockey boot.

The ski boot shown in FIG. 1 has a sole 1 onto which are shaped an upper part with two closing flaps 2, 3, whose edges 4, 5 form a gap on the instep side and are covered by a tongue 6, only partly visible in FIG. 1, guided in a cover plate 10 provided on cap 8.

A cushioned inner shoe is placed in the upper part and the back of the upper portion 12 of the inner shoe is open to the sole and can be covered by a heel tongue 13 fixed to upper portion 12 in the vicinity of the sole of the inner shoe. The heel tongue 13 of the inner shoe is covered by a heel portion 14, pivoted in the vicinity of sole 1 in two pins 15 arranged in the rear end of closing flaps 2, 3.

Two fixing straps 17, each of which has a guide 18 are fixed so as to face one another on the edges 4, 5 of closing flaps 2, 3, whilst on either side of the gap on the instep side in the shaft portion of closing flaps 2, 3 a guide 19 is provided, which is partly located within heel portion 14. Guides 18 can be curved tube lengths, curved grooves or parts of the covering of a Bowden cable, whilst guide 19 can be a plastics member provided with a groove or the covering of a Bowden cable. In each of the guides 18 and in the exposed guide portion 16 is located a tension member 20, 61, e.g. a steel cable, which are either interconnected on the toe side or, as shown by dotted lines in FIG. 1, are fixed at edges 4, 5 in fixing portions 17'. The two tension members 20, 61 pass to and fro approximately symmetrically over the gap located between edges 4, 5, whilst the upper end of tension members 20, 61 terminate in an arc in the area between two tightening flaps 40, 41 in a tightening fastener to be described hereinafter. Flaps 40, 41 form part of heel portion 14. Guide portions 19 are fixed to edges 4, 5 by supporting members 17'' whilst the other end of guide portions 19 is fixed in a manner to be described hereinafter to flaps 40, 41.

As can be gathered from FIGS. 4 – 6 guides portions 16 can be constructed in various ways. All three embodiments of guide portions 16 are adjustable, so that the guidance path of tension members 20, 61 can be varied, so that the tension produced on closing the ski boot can be adapted to the size of the skier's foot.

FIG. 4 shows the interconnection of guides 18 of guide portion 16 by means of screw bolts 55. The reciprocal spacing of guides 18 can be modified by turning the bolts, so that the guidance path of the two tensional members 20, 61 can be changed.

In the case of guide portions 16 of FIG. 5 the guides 18 are in each case connected to a clip 56, 57, fixed via flaps to the edges 4, 5 by means of screw bolts 58. The tension of the two tension members 20, 61 can be varied in that clips 56, 57 have different openings 59 into which the bolts 58 can be screwed.

In the case of guide portions 16 of FIG. 6 clips 56, 57 are used on which are fixed guide members 18 with an opposite curvature to that of FIG. 5. In this case tension members 20, 61 cross one another. The tension can be varied in the same way by screwing bolt 58 into corresponding holes 59.

FIGS. 2 and 3 show a tightening fastener 33 which permits the tightening of tightening flaps 40, 41 and the two tension members 20, 61. The end of tension member 20 is fixed in a dog 25 which is connected with a fastening clip 22. Fastening clip 22 and dog 25 are displaceably guided in a slot 21 of a guide plate 51 and flap 40, whereby in the position shown in FIG. 3 dog 25 has effected the maximum tensioning path and engages on a stop 23. Guide plate 51 has a projection 52 through which extends tension member 20 and on which is supported guide 19.

Fastening clip 22 has a plurality of hooks 42. In one of the latter is hung a tightening strap 35 which forms part of the tightening fastener 33. Tightening strap 35 is pivoted in a tightening lever 34. At one end of lever 34 is pivoted an extension and covering member 37 having an end 37 which projects over the bearing of lever 34. The other end of lever 34 is pivoted in a tension bar 60 which, together with a further dog 62, projects into a guidance slot 64 arranged in a guide plate 63 and tightening flap 41. To dog 62 is fixed the end of tension member 61 which extends through a projection 65 arranged on guide plate 63 and on which is supported guide 19 of tension member 61.

FIG. 3 shows the tightening fastener 33 just before it reaches the completely tightened position. In the latter position the extension and covering member 37 covers the fastener. On opening firstly the extension and covering member 37 is raised, the end 37' thereof being supported on guide plate 63. As a result tightening lever 34 is raised from its position directly on guide plate 63 and is pivoted until the tightening strap 35 can be removed. Thus, tension members 20, 61 can be loosened in the instep portion, so that the two dogs 25, 62 move against the bent portions 52, 65 of guide plates 51, 63, which frees a sufficient length of tension members 20, 61 to enable the foot to be easily removed from the ski boot. Entry into the ski boot is just as easy because a relatively large amount of space is available due on the one hand to the opening of flaps 40, 41 and on the other due to the relaxation of tension members 20, 61 through the displacement of dogs 25, 62.

However, it would also be possible to position the adjusting means for tension members 20, 61 at another point, e.g. at the ends thereof on the toe side. It is also possible to use guide portions 16 in its simplest construction according to FIG. 1 and to make the setting of tension members 20, 61 once and for all when trying out the ski boot, thereby obviating further adjustment possibilities. Guide portion 16 according to FIG. 6 can then be constructed in such a way that guides 18 are fixed to edges 4, 5, e.g. by riveting. The crossing arrangement of tension members 20, 61 is still retained with a fixed arrangement of guide members 18 of guide portion 16.

Tightening fastener 33 is also suitable for use on skating boots, particularly ice hockey boots where there is no need for a separate heel portion 14 with tightening flaps 40, 41. The increased tightening length as a result of the two tension members 20, 61 compared with a single tension member then has a particularly advantageous action. When there are no tightening flaps in a simple construction of the boot the tightening fastener 33 can be simplified through not guiding the tightening clip 22 and tension bar 60 in guide slots 21 or 64. It is important for the tightening fastener or its fastening clip 22 and tension bar 60 to be connected with in each case one end of tension members 20, 61.

FIGS. 7 and 8 show two fastener arrangements as can be used for ice hockey or skating boots.

The ice hockey boots shown in FIG. 7 has a sole 1 and an upper part with two closing flaps 2, 3, whose edges 4, 5 form a gap on the instep side covered by a tongue 6, which on the toe side passes into a cap 8.

Two fastening clips with in each case a guide 18 are fixed in facing manner on the edges 4, 5 of closing flaps 2, 3, whilst in the shaft portion of flaps 2, 3 a guide 19 is arranged on either side and pass in part over the inside of the upper part. Guides 18, 19 can be constructed in the same way as in the embodiment of FIG. 1. A tension member 20, 61, fixed in fixing member 17', is located in each of the guides 18, 19. However, it is here again possible to combine the two tension members 20, 61 on the toe side. Guides 19 are held on edges 4, 5 by supporting members 17''.

Tightening fastener 33 is constructed in the same way as that described in FIGS. 2 and 3. However, if fastening clip 22 or tension bar 60 is not guided in guide slots 21, 64, the entire tightening length of the tightening fastener serves to tighten tension members 20, 61.

FIG. 8 shows a side view of the upper part of the shaft of an ice hockey boot. Thus, only tension member 61 is shown and is guided via guides 18, 19 and via a guide portion 16, as shown for example in FIG. 4. Guide 19 terminates at the lower end of a guide band 70 on which is guided a slide 71 to which is fixed the end of tension member 61. Slide 71 has a hook 72 which for tightening the tension member 61 can be hung in a gap formed by one edge 73 of guide band 70 by means of a tension rod 74. The same tightening device for the not shown tension member is provided on the other side of the shaft. Tension rod 74 interconnects the two slides 71, so that tension members 20, 61 can be simultaneously tightened and relaxed. The important point here is that through the use of tensioning members at the end of a tension member guided in each case in guides 18, 19 a firm fixing of the boot to the foot is achieved and on relaxing the tension member a relatively large insertion and removal opening is provided.

I claim:

1. A ski and skating boot of the type having closing flaps and a fastening, the fastening including:

a first tension member guided alternately between the closing flaps by guides to cover the insertion opening in the upper part of the boot located in the vicinity of the instep, a tightening fastener connected to the end of the first tension member, the fastener including:

a tightening lever located on one closing flap, a fastening clip on the other closing flap, the clip being connected to the end of the first tension member, wherein the improvement comprises that said tightening lever is connected to one end of a second tension member also guided alternately between said closing flaps by guides.

2. A boot according to claim 1, wherein the tightening lever acts on a tension rod and each is provided with one dog projecting into guide slots, the ends of the slots forming stops for the dogs.

3. A boot according to claim 1, wherein the second tension member is guided identically and in opposite direction to the first tension member.

4. A boot according to claim 1, wherein the two tension members are guided in an exposed guide portion arranged on the instep side with in each case one guide, whereby the guides have oppositely directed curvatures.

5. A boot according to claim 4, wherein the distance between the guides of the guide portion is adjustable, e.g. by means of a setscrew.

6. A boot according to claim 5, wherein the tension members cross one another in the guide portion.

7. A boot according to claim 1, wherein the tightening fastener is arranged on the closing flaps on the back of the shaft.

* * * * *